US011002147B2

(12) United States Patent
Dyer

(10) Patent No.: US 11,002,147 B2
(45) Date of Patent: May 11, 2021

(54) FIXED VANE PACK RETAINING RING

(71) Applicant: UNITED TECHNOLOGIES CORPORATION, Farmington, CT (US)

(72) Inventor: David M. Dyer, Glastonbury, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 269 days.

(21) Appl. No.: 16/114,975

(22) Filed: Aug. 28, 2018

(65) Prior Publication Data

US 2020/0072072 A1 Mar. 5, 2020

(51) Int. Cl.
*F01D 25/24* (2006.01)
*F01D 17/16* (2006.01)

(52) U.S. Cl.
CPC ..... *F01D 17/16* (2013.01); *F01D 25/246* (2013.01); *F05D 2220/32* (2013.01); *F05D 2230/60* (2013.01); *F05D 2240/12* (2013.01)

(58) Field of Classification Search
CPC ..... F01D 25/246; F01D 17/16
See application file for complete search history.

(56) References Cited

U.S. PATENT DOCUMENTS 2,937,000 A 5/1960 Ledwith
3,075,744 A 1/1963 Peterson
7,121,789 B2 * 10/2006 Richards ..... F01D 25/246 415/173.1
8,206,100 B2 6/2012 Schuler et al.

* cited by examiner

*Primary Examiner* — David E Sosnowski
*Assistant Examiner* — Sabbir Hasan
(74) *Attorney, Agent, or Firm* — Cantor Colburn LLP

(57) ABSTRACT

A gas turbine engine includes a case, a stator vane, and a retainer. The case has a first surface, a second surface, a third surface extending between the first surface and the second surface, and a hook extending from the second surface and disposed opposite the third surface. The stator vane includes a shroud body and a first flange. The retainer is arranged to seat the first flange within a first slot defined between the hook and the second surface and secure the shroud body to the case.

16 Claims, 2 Drawing Sheets

FIXED VANE PACK RETAINING RING

STATEMENT OF FEDERAL SUPPORT

This invention was made with Government support awarded by the United States. The Government has certain rights in the invention.

BACKGROUND

Exemplary embodiments of the present disclosure pertain to the art of gas turbine engines.

Gas turbine engines include one or more rows of stationary or movable airfoils that are commonly referred to as stators or vanes. The stators or vanes are arranged to turn or straighten airflow that is directed towards a downstream stage of airfoils. The stators or vanes are installed into the gas turbine engine by hooking the stator or vane into openings of a support structure. Some stators or vanes are difficult to install into the gas turbine engine by hooking due to the size of the arrangement of the stators or vanes.

Accordingly, it is desirable to provide a simplified structure to facilitate the installation of stators or vanes into the gas turbine engine.

BRIEF DESCRIPTION

Disclosed is a gas turbine engine that includes a case, a stator vane, and a retainer. The case has a first surface, a second surface disposed parallel to the first surface, a third surface extending between the first surface and the second surface, and a hook extending from the second surface and disposed opposite the third surface. The stator vane includes a shroud body that axially extends between a first body end and a second body end, the shroud body having a first flange that extends from the first body end and extends between the hook and the second surface. The retainer is disposed between the second body end and the third surface, the retainer arranged to seat the first flange within a first slot defined between the hook and the second surface and secure the shroud body to the case.

In addition to one or more of the features described above, or as an alternative to any of the foregoing embodiments, the retainer is arranged as at least a portion of an arcuate ring.

In addition to one or more of the features described above, or as an alternative to any of the foregoing embodiments, the retainer includes a first retainer surface that engages the second surface, a second retainer surface disposed opposite the first retainer surface, a first side surface extending between the first retainer surface and the second retainer surface, and a second side surface disposed opposite the first side surface and extending between the first retainer surface and the second retainer surface.

In addition to one or more of the features described above, or as an alternative to any of the foregoing embodiments, the first side surface engages the second body end and the second side surface engages the third surface of the case.

In addition to one or more of the features described above, or as an alternative to any of the foregoing embodiments, a fastener extends through the case and into the retainer to secure the retainer and the shroud body to the case.

In addition to one or more of the features described above, or as an alternative to any of the foregoing embodiments, the second body end of the shroud body defines an engagement surface.

In addition to one or more of the features described above, or as an alternative to any of the foregoing embodiments, the first side surface engages the engagement surface.

In addition to one or more of the features described above, or as an alternative to any of the foregoing embodiments, the third surface is disposed in a non-parallel and non-perpendicular relationship with the first surface and the second surface.

In addition to one or more of the features described above, or as an alternative to any of the foregoing embodiments, the second side surface engages the third surface.

Also disclosed is a gas turbine engine having a central longitudinal axis. The gas turbine engine includes a case, a vane pack, and a retainer. The case is disposed about the central longitudinal axis of the gas turbine engine. The case has a first surface, a second surface, a third surface extending between the first surface and the second surface, and a first slot defined between the second surface and a hook. The vane pack has a stator vane with a shroud body and an airfoil. The shroud body axially extends between a first body end and a second body end. The shroud body has a first flange that extends from the first body end into the first slot. The airfoil radially extends from the shroud body towards the central longitudinal axis and axially extends between a leading edge and a trailing edge. The retainer is disposed between the second body end and the third surface, the retainer being arranged to at least partially secure the stator vane to the case.

In addition to one or more of the features described above, or as an alternative to any of the foregoing embodiments, the stator vane defines a receiving area that is defined between the shroud body and the airfoil and axially extends from the second body end towards the first body end.

In addition to one or more of the features described above, or as an alternative to any of the foregoing embodiments, the retainer extends into the receiving area.

In addition to one or more of the features described above, or as an alternative to any of the foregoing embodiments, the retainer includes a first retainer surface, a second retainer surface disposed opposite the first retainer surface, a first side surface extending between the first retainer surface and the second retainer surface, and a second side surface disposed opposite the first side surface and extending between the first retainer surface and the second retainer surface.

In addition to one or more of the features described above, or as an alternative to any of the foregoing embodiments, the retainer has a first width that axially extends between the first side surface and the second side surface, proximate the first retainer surface.

In addition to one or more of the features described above, or as an alternative to any of the foregoing embodiments, the retainer has a second width that axially extends between the first side surface and the second side surface, proximate the first retainer surface.

In addition to one or more of the features described above, or as an alternative to any of the foregoing embodiments, the second width is greater than first width.

In addition to one or more of the features described above, or as an alternative to any of the foregoing embodiments, the second body end of the shroud body defines an engagement surface that is disposed in a non-parallel and non-perpendicular relationship with respect to the trailing edge.

Further disclosed is a method of assembling a portion of a gas turbine engine. The method includes retaining a shroud of a gas turbine engine to a case of the gas turbine engine by: a) inserting a first flange of the shroud into a first slot of a case of the gas turbine engine, b) abutting a retainer against an engagement surface of the shroud body and a surface of the case, and c) coupling the retainer to the case.

In addition to one or more of the features described above, or as an alternative to any of the foregoing embodiments, the retainer includes a first retainer surface, a second retainer surface disposed opposite the first retainer surface, a first side surface extending between the first retainer surface and the second retainer surface, and a second side surface disposed opposite the first side surface and extending between the first retainer surface and the second retainer surface.

In addition to one or more of the features described above, or as an alternative to any of the foregoing embodiments, the first side surface engages the engagement surface and the first retainer surface engages the surface of the case.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
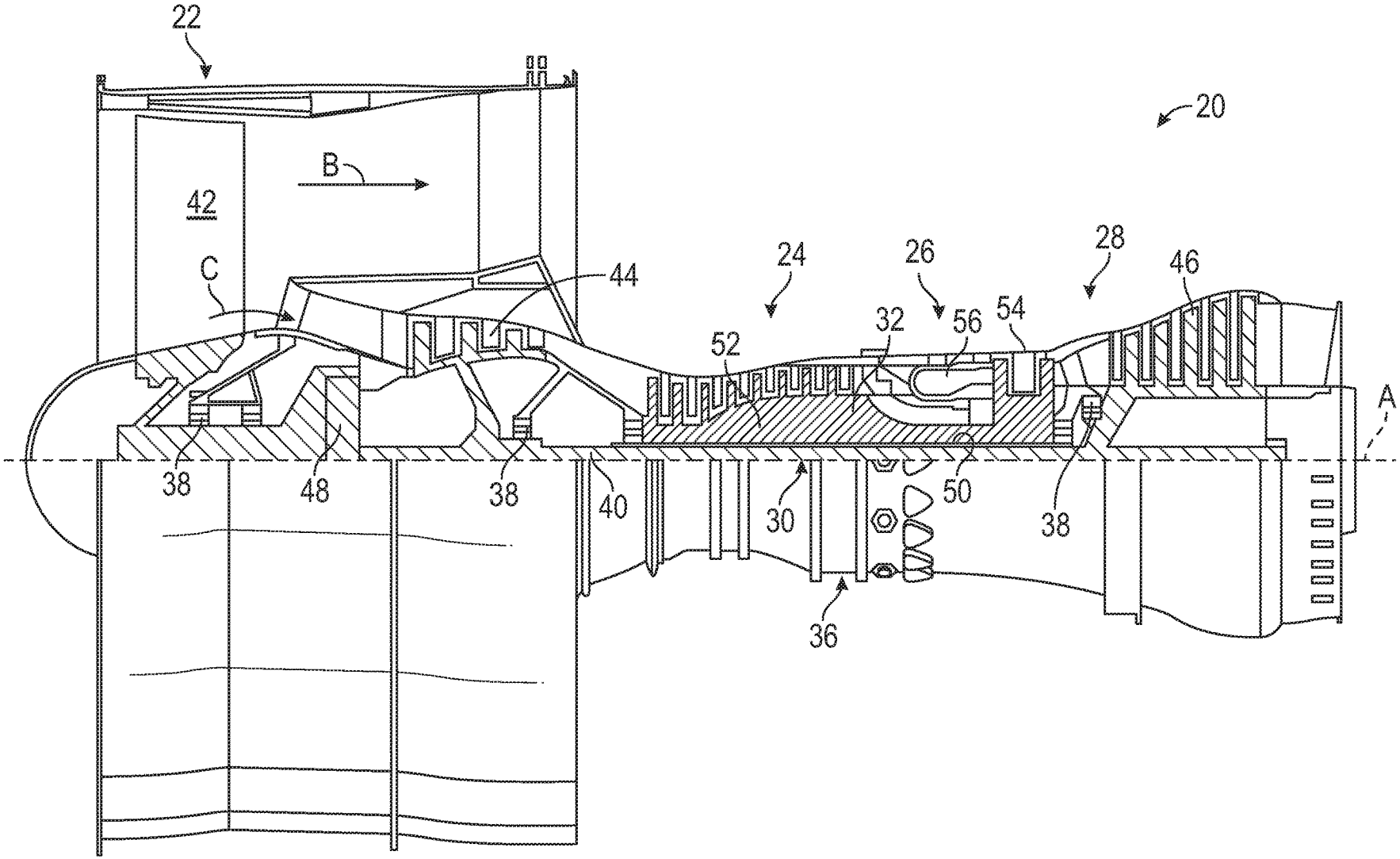
FIG. 1 is a partial cross-sectional view of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26, and a turbine section 28. Alternative engines might include other systems or features. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in exemplary gas turbine 20 between the high pressure compressor 52 and the high pressure turbine 54. An engine static structure 36 is arranged generally between the high pressure turbine 54 and the low pressure turbine 46. The engine static structure 36 further supports bearing systems 38 in the turbine section 28. The inner shaft 40 and the outer shaft 50 are concentric and rotate via bearing systems 38 about the engine central longitudinal axis A, which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five (5:1). Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present disclosure is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,688 meters). The flight condition of 0.8 Mach and 35,000 ft (10,688 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram °R})/(518.7\text{°R})]^{0.5}$. The "Low corrected fan tip speed" as disclosed herein according to one non-limiting embodiment is less than about 1150 ft/second (350.5 m/sec).

Figure 2:
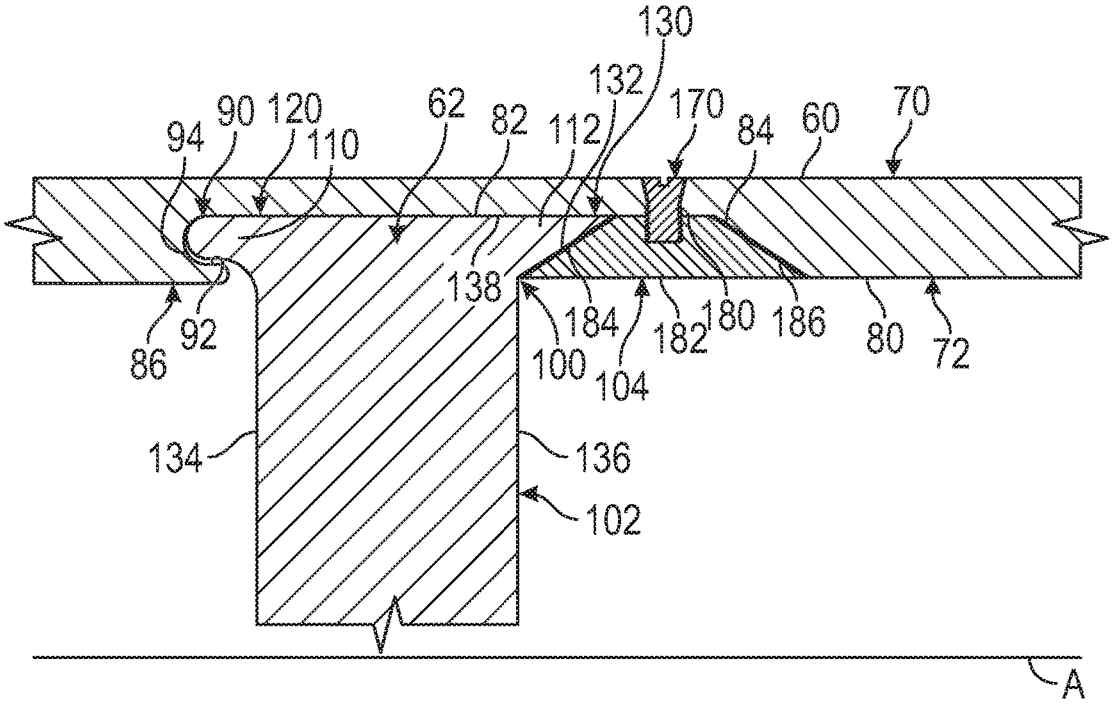
FIG. 2 is a partial section view of a portion of the gas turbine engine.
Figure 3:
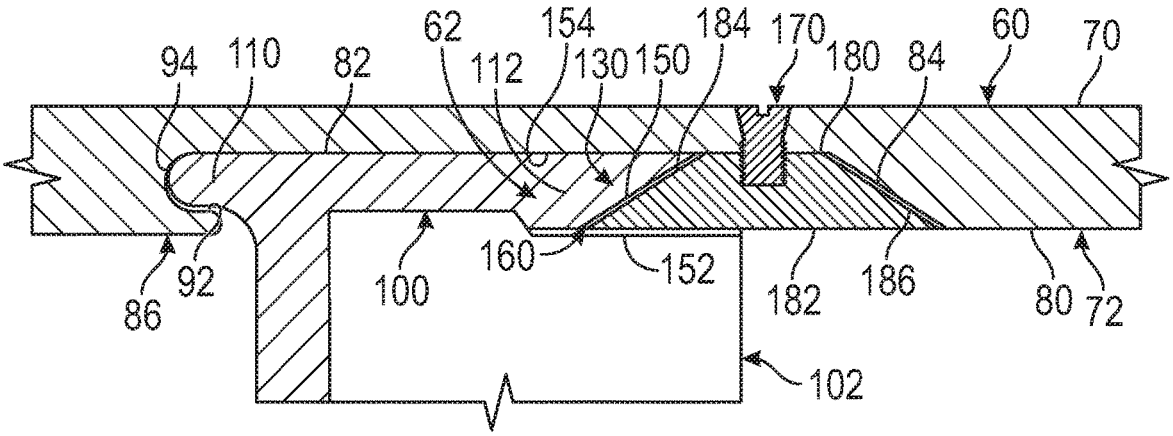
FIG. 3 is a partial section view of a portion of the gas turbine engine.

Referring to FIGS. 2 and 3, the compressor section 24 or the turbine section 28 may include at least a portion of a case 60 that at least partially supports a stator array, stator segments, a stator vane, or a vane pack 62. The vane pack 62 may be a fixed vane pack, fixed vane and variable vane combination, or a 180° plus vane pack that may be fitted to the case 60.

The case 60 is disposed about the central longitudinal axis A of the gas turbine engine 20. The case 60 includes an outer portion 70 and an inner portion 72 that is disposed opposite the outer portion 70.

The inner portion 72 of the case 60 includes a first surface 80, a second surface 82, a third surface 84, and a hook 86. The first surface 80 is disposed generally parallel to the central longitudinal axis A. The second surface 82 is disposed generally parallel to and is radially offset from the first surface 80, relative to the central longitudinal axis A. The third surface 84 extends between the first surface 80 and the second surface 82. The third surface 84 is disposed in a non-parallel and a non-perpendicular relationship with the first surface 80 and the second surface 82, such that the third surface 84 is at least one of an inclined surface or a declined surface.

The hook 86 is disposed opposite the third surface 84 and extends from the second surface 82. A first slot 90 is defined between the hook 86 and the second surface 82. The first slot 90 includes a first slot surface 92 and a first slot end surface 94. The first slot surface 92 is disposed generally parallel to and is disposed opposite the second surface 82. The first slot end surface 94 radially extends between the first slot surface 92 and the second surface 82.

The vane pack 62 is installed into the recess region that is defined between the hook 86, the second surface 82, and the third surface 84. The vane pack 62 includes a shroud body 100 and an airfoil 102 that radially extends from the shroud body 100 towards the central longitudinal axis A. The shroud body 100 may be an outer diameter shroud or an outer diameter platform that is secured to the case 60 via the first slot 90/the hook 86 and a retainer 104.

The shroud body 100 axially extends between a first body end 110 and a second body end 112. The shroud body 100 has a first flange 120 that axially extends from the first body end 110 and extends into or is inserted into the first slot 90. The first flange 120 is disposed between the hook 86 and the second surface 82.

Referring to FIG. 2, the shroud body 100 has a second flange 130 that axially extends from the second body end 112 towards the third surface 84. The second flange 130 defines an engagement surface 132 that extends between at least one of a leading edge 134 or a trailing edge 136 of the airfoil 102 and a top surface 138 of the shroud body 100 that engages or is disposed proximate the second surface 82 of the case 60. The engagement surface 132 is disposed in a non-parallel and non-perpendicular relationship with respect to the central longitudinal axis A and at least one of the leading edge 134, the trailing edge 136, or the top surface 138.

Referring to FIG. 3, the shroud body 100 has the second flange 130 that axially extends from the second body end 112 towards the third surface 84. The second flange 130 defines an engagement surface 150 that extends from a tip 152 of the airfoil 102 to a top surface 154 of the shroud body 100 that engages or is disposed proximate the second surface 82 of the case 60. The engagement surface 150 is disposed in a non-parallel and a non-perpendicular relationship with respect to the central longitudinal axis A and the top surface 154. A receiving area 160 is defined between the engagement surface 150 of the shroud body 100 and the tip 152 of the airfoil 102. The receiving area 160 axially extends from the second body end 112 towards the first body end 110.

Referring to FIGS. 2 and 3, the retainer 104 is arranged to facilitate retaining the vane pack 62 to the case 60 of the gas turbine engine 20. The retainer 104 is disposed between the second body end 112 of the shroud body 100, the second surface 82 of the case 60, and the third surface 84 of the case 60. The retainer 104 is arranged to receive a fastener 170 to secure the shroud body 100 of the stator vane or vane pack 62 to the case 60 after the first flange 120 is inserted into the first slot 90 of the case 60. The retainer 104 may also further seat the first flange 120 within the first slot 90 due the abutment of the retainer 104 with the engagement surface 132, 150 of the shroud body 100. The retainer 104 is arranged as an arcuate retaining ring or an arcuate retaining ring segment that is coupled to the case 60 by the fastener 170.

The retainer 104 includes a first retainer surface 180, a second retainer surface 182, a first side surface 184, and a second side surface 186. The first retainer surface 180 is arranged to engage the second surface 82 of the case 60. The second retainer surface 182 is disposed opposite and may be disposed generally parallel to the first retainer surface 180. The second retainer surface 182 is spaced apart from any portion of the airfoil 102, as shown in FIG. 2. The second retainer surface 182 engages or may be disposed proximate the tip 152 of the airfoil 102, as shown in FIG. 3.

The first side surface 184 extends between the first retainer surface 180 and the second retainer surface 182. The first side surface 184 is arranged to engage the engagement surface 132 of the shroud body 100, as shown in FIG. 2. The retainer 104 extends into the receiving area 160, as shown in FIG. 3, such that the first side surface 194 is arranged to engage the engagement surface 150 of the shroud body 100.

The second side surface 186 is disposed opposite the first side surface 184. The second side surface 186 extends between the first retainer surface 180 and the second retainer surface 182. The second side surface 186 is arranged to engage the third surface 84 of the case 60, as shown in FIGS. 2 and 3.

The retainer 104 has a first width that axially extends between the first side surface 184 and the second side surface 186, proximate the first retainer surface 180. The retainer 104 has a second width that axially extends between the first side surface 184 and the second side surface 186, proximate the second retainer surface 182. The second width is greater than the first width such that the retainer 104 has a general wedge shape.

The fastener 170 utilizes the wedge shape of the retainer 104 to facilitate the seating of the first flange 120 into the first slot 90 and the securing of the shroud body 100 to the case 60. The fastener 170 may extend from the outer portion 70 of the case 60 through the inner portion 72 of the case 60, through the first retainer surface 180, and into the retainer 104, as shown in FIG. 2. In this arrangement, the fastener 170 is separated from a flow path of the gas turbine engine 20. The fastener 170 may extend from the second retainer surface 182, through the retainer 104, through the first retainer surface 180, through the inner portion 72 of the case 60, and into the case 60.

The retainer 104 facilitates the installation of the vane pack 62 to the case 60 of the gas turbine engine 20. The retainer 104 also improves seating of the first flange 120 into the first slot 90 such that a gap that may be present between the hook 86 of the case 60 and the first body end 110 of the shroud body 100 may be closed due to the torquing of the fastener 170. The reduction in size of the gap may improve sealing between the vane pack 62 and the case 60 to provide a more aerodynamic flow path.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A gas turbine engine, comprising:

a case having a first surface, a second surface, a third surface extending between the first surface and the second surface, and a hook extending from the second surface and disposed opposite the third surface;

a stator vane, comprising:

a shroud body that axially extends between a first body end and a second body end, the shroud body having a first flange that extends from the first body end and extends between the hook and the second surface; and a retainer disposed between the second body end and the third surface, the retainer arranged to seat the first flange within a first slot defined between the hook and the second surface and secure the shroud body to the case, wherein the retainer includes a first retainer surface that engages the second surface, a second retainer surface disposed opposite the first retainer surface, a first side surface extending between the first retainer surface and the second retainer surface, and a second side surface disposed opposite the first side surface and extending between the first retainer surface and the second retainer surface and wherein the third surface is disposed in a non-parallel and non-perpendicular relationship with the first surface and the second surface.

2. The gas turbine engine of claim 1, wherein the retainer is arranged as at least a portion of an arcuate ring.

3. The gas turbine engine of claim 1, wherein the first side surface engages the second body end and the second side surface engages the third surface of the case.

4. The gas turbine engine of claim 1, wherein a fastener extends through the case and into the retainer to secure the retainer and the shroud body to the case.

5. The gas turbine engine of claim 1, wherein the second body end of the shroud body defines an engagement surface.

6. The gas turbine engine of claim 5, wherein the first side surface engages the engagement surface.

7. The gas turbine engine of claim 1, wherein the second side surface engages the third surface.

8. A gas turbine engine having a central longitudinal axis, comprising:

a case disposed about the central longitudinal axis of the gas turbine engine, the case having a first surface, a second surface, a third surface extending between the first surface and the second surface, and a first slot defined between the second surface and a hook;

a vane pack having a stator vane, comprising:

a shroud body that axially extends between a first body end and a second body end, the shroud body having a first flange that extends from the first body end into the first slot, and an airfoil that radially extends from the shroud body towards the central longitudinal axis and axially extends between a leading edge and a trailing edge; and a retainer disposed between the second body end and the third surface, the retainer being arranged to at least partially secure the stator vane to the case, wherein the retainer includes a first retainer surface that engages the second surface, a second retainer surface disposed opposite the first retainer surface, a first side surface extending between the first retainer surface and the second retainer surface, and a second side surface disposed opposite the first side surface and extending between the first retainer surface and the second retainer surface and wherein the third surface is disposed in a non-parallel and non-perpendicular relationship with the first surface and the second surface.

9. The gas turbine engine of claim 8, wherein the stator vane defines a receiving area that is defined between the shroud body and the airfoil and axially extends from the second body end towards the first body end.

10. The gas turbine engine of claim 9, wherein the retainer extends into the receiving area.

11. The gas turbine engine of claim 9, wherein the retainer has a first width that axially extends between the first side surface and the second side surface, proximate the first retainer surface.

12. The gas turbine engine of claim 11, wherein the retainer has a second width that axially extends between the first side surface and the second side surface, proximate the first retainer surface.

13. The gas turbine engine of claim 12, wherein the second width is greater than first width.

14. The gas turbine engine of claim 9, wherein the second body end of the shroud body defines an engagement surface that is disposed in a non-parallel and non-perpendicular relationship with respect to the trailing edge.

15. A method of assembling a portion of a gas turbine engine, comprising:

retaining a shroud of a gas turbine engine to a case of the gas turbine engine by:

inserting a first flange of the shroud into a first slot of the case of the gas turbine engine;

abutting a retainer against an engagement surface of the shroud and a first surface of the case, the case further comprising a second surface, and a third surface extending between the first surface and the second surface, wherein the retainer includes a first retainer surface that engages the first surface of the case, a second retainer surface disposed opposite the first retainer surface, a first side surface extending between the first retainer surface and the second retainer surface the first side surface contacting the engagement surface of the shroud, and a second side surface disposed opposite the first side surface and extending between the first retainer surface and the second retainer surface and wherein the third surface is disposed in a non-parallel and non-perpendicular relationship with the first surface and the second surface; and coupling the retainer to the case.

16. A gas turbine engine, comprising:

a case having a first surface, a second surface, a third surface extending between the first surface and the second surface, and a hook extending from the second surface and disposed opposite the third surface;

a stator vane, comprising:

a shroud body that axially extends between a first body end and a second body end, the shroud body having a first flange that extends from the first body end and extends between the hook and the second surface; and a retainer disposed between the second body end and the third surface, the retainer arranged to seat the first flange within a first slot defined between the hook and the second surface and secure the shroud body to the case, wherein the retainer includes a first retainer surface that engages the second surface, a second retainer surface disposed opposite the first retainer surface, a first side surface extending between the first retainer surface and the second retainer surface, and a second side surface disposed opposite the first side surface and extending between the first retainer surface and the second retainer surface; and a fastener extends through the case and into the retainer to secure the retainer and the shroud body to the case.

* * * * *